US005755820A

United States Patent [19]

Lan-Jen

[11] Patent Number: 5,755,820

[45] Date of Patent: May 26, 1998

[54] PRONG FOR A LOW PROFILE PLUG

[76] Inventor: Tsang Lan-Jen, No. 1, Lane 199, Sec. 1, Min Chuan Rd., Tainan, Taiwan

[21] Appl. No.: 763,814

[22] Filed: Dec. 11, 1996

[51] Int. Cl.[6] ..... H01R 13/04

[52] U.S. Cl. ..... 439/694; 439/881

[58] Field of Search ..... 439/694, 881, 439/877, 884, 736

[56] References Cited

U.S. PATENT DOCUMENTS

| | | | |
|---|---|---|---|
| 3,086,191 | 4/1963 | O Lashaw | 439/694 |
| 4,284,317 | 8/1981 | Doyle | 439/694 |
| 4,927,376 | 5/1990 | Dickie | 439/694 |

FOREIGN PATENT DOCUMENTS

| | | | |
|---|---|---|---|
| 3-57175 | 3/1991 | Japan | 439/694 |

*Primary Examiner*—Hien Vu

*Attorney, Agent, or Firm*—Morton J. Rosenberg; David I. Klein; Jun Y. Lee

[57] ABSTRACT

A prong for a low profile plug consists of an exposed segment forming a plugging portion and a covered segment which is divided into two separated lugs. The two lugs are bent horizontally in opposite directions. One of the lugs has two fins that are bent up to form a U-shaped groove for receiving a wire therein. In one embodiment, the lug without the two fins is divided into two sub-lugs, each extending in opposite directions. The covered segment is thinner than the exposed segment.

1 Claim, 7 Drawing Sheets

PRONG FOR A LOW PROFILE PLUG

BACKGROUND OF THE INVENTION (1) Field of the Invention

The present invention related to a prong for a low profile plug, and more particularly to a thin one-piece prong.

(2) Description of Prior Art

In accordance with prior art, as showing in FIG. 7, the conventional full plug is designed with a thin prong which have advantages of saving space and increasing its attraction, meanwhile it must have enough base supporting area for standing firmly and sticking on the socket stably. For example, U.S. Pat. No. 4,927,376 disclosed a full plug with doubling copper strip prongs, in which the two free lugs at the open end are bent to both sides respectively and horizontally as opening two side wings to increase the base supporting area, then they are arranged into an injection mould, injection moulding plastic into the plastic body in mould so that the lateral base portions of the prongs are enclosed to become an integrated plug. But there are some shortcomings as following:

1. Due to the doubling line exists, the folded end of the plugger can not be formed to an arch shape.
2. Owing to the above, many users request a one-piece prong structure.

OBJECTS AND SUMMARY OF THE INVENTION

It is therefore one object of this invention to provide a full plug with a one-piece prong structure. The present invention provides a prong of a low profile plug, which consists of an exposed segment as a plugging portion and a covered segment that is divided into two separated lugs, they can be bent to opposite directions horizontally and respectively, one of which has two fins that can be bent up to form an U-shaped groove to secure a cord therein as a clip. For the convenience of processing, the covered segment should be thinner than the exposed segment. In processing, the covered segments are covered by an injected plastic to form an integral plug. In this way, the top end of the prongs can be easily processed to have an arched head.

DETAILED DESCRIPTION OF PREFERRED EMBODIMENTS

Figure 1:
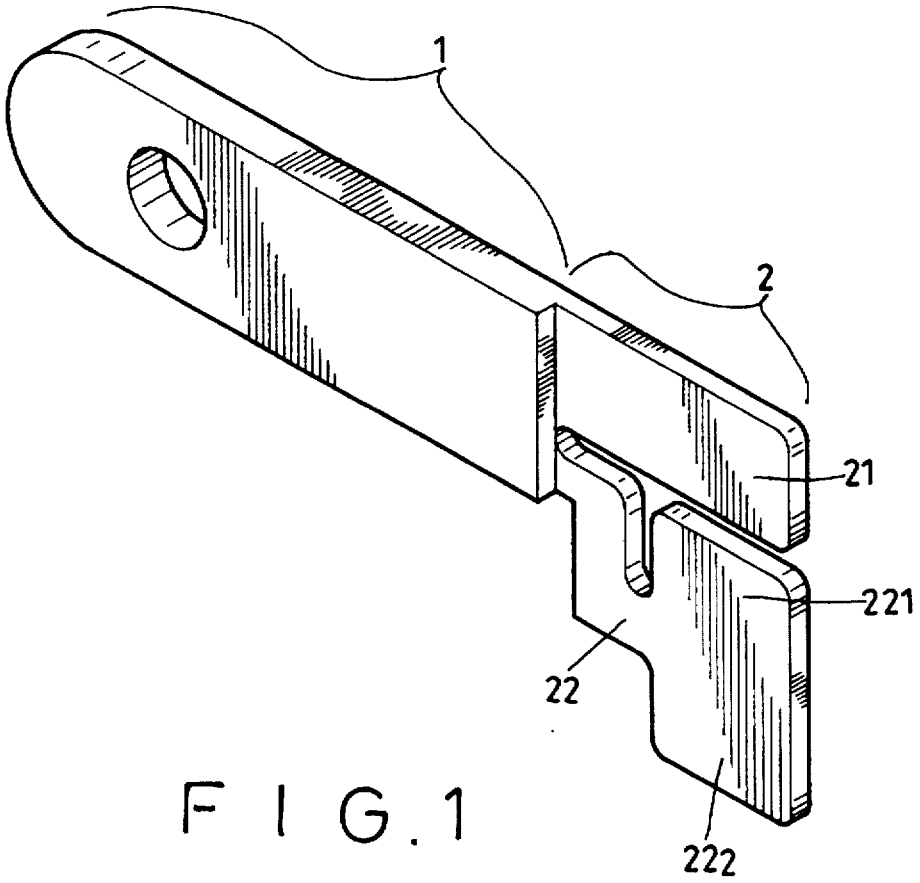
FIG. 1 is a perspective view showing an unfolded strip of the present invention.
Figure 2:
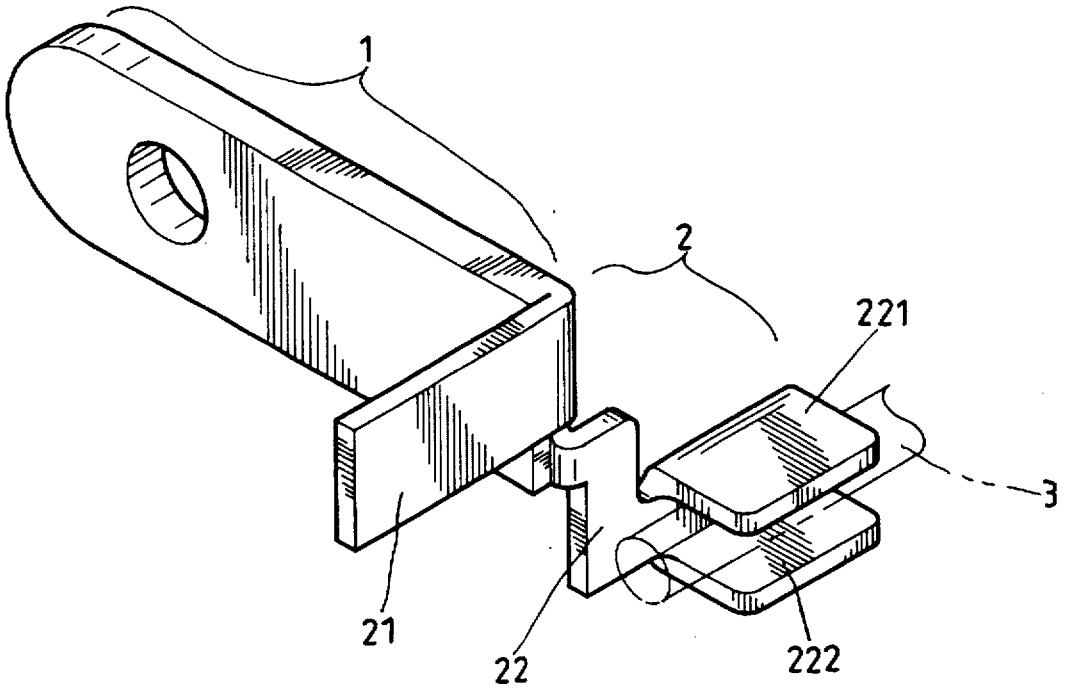
FIG. 2 is a similar view of FIG. 1 having the bottom portion bent to form clip thereat.

Referring to FIG. 1 and FIG. 2, the present invention consists of an exposed segment 1 and a covered segment 2. The covered segment 2 is thinner than the exposed segment 1, and is divided into two separated lugs 21 and 22, they can be bent to an opposite directions horizontally and respectively, one of which lugs has two fins 221 and 222 in which they can be bent upwards to form an U-shaped groove for fixing a cord therein as a clip.

Figure 3:
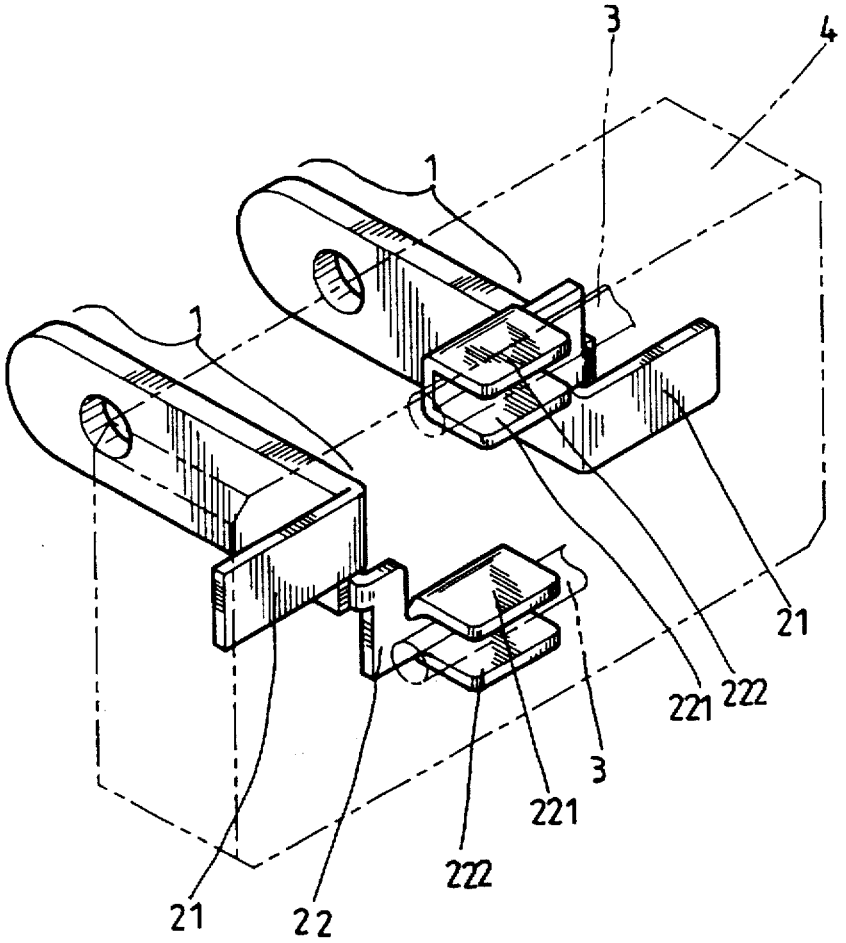
FIG. 3 is a solid view showing an operation of the present invention.
Figure 4:
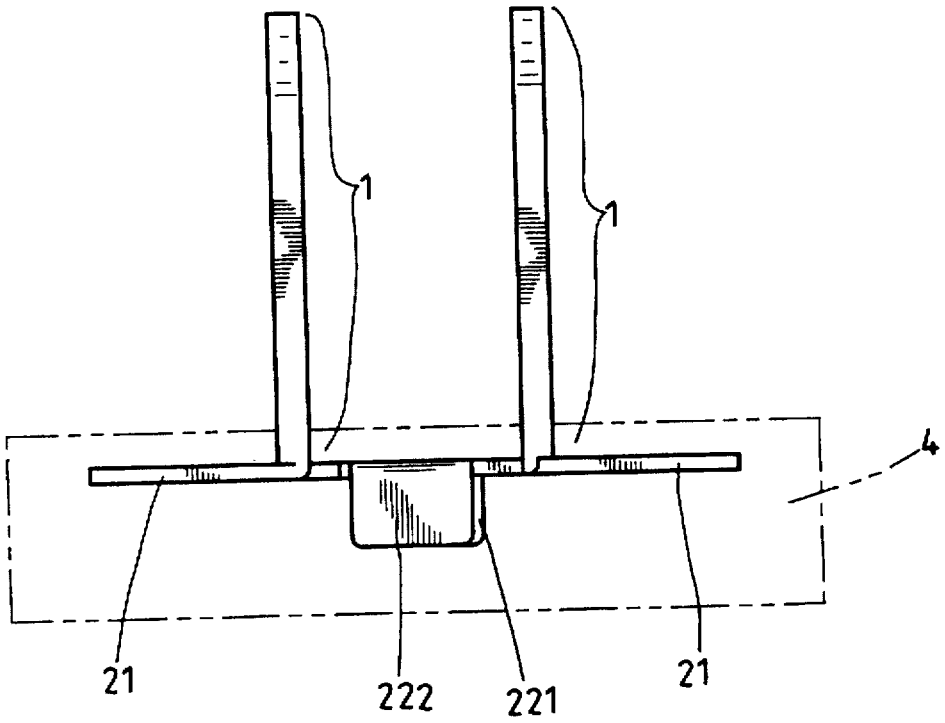
FIG. 4 is a top view showing the operation of the present invention.
Figure 5:
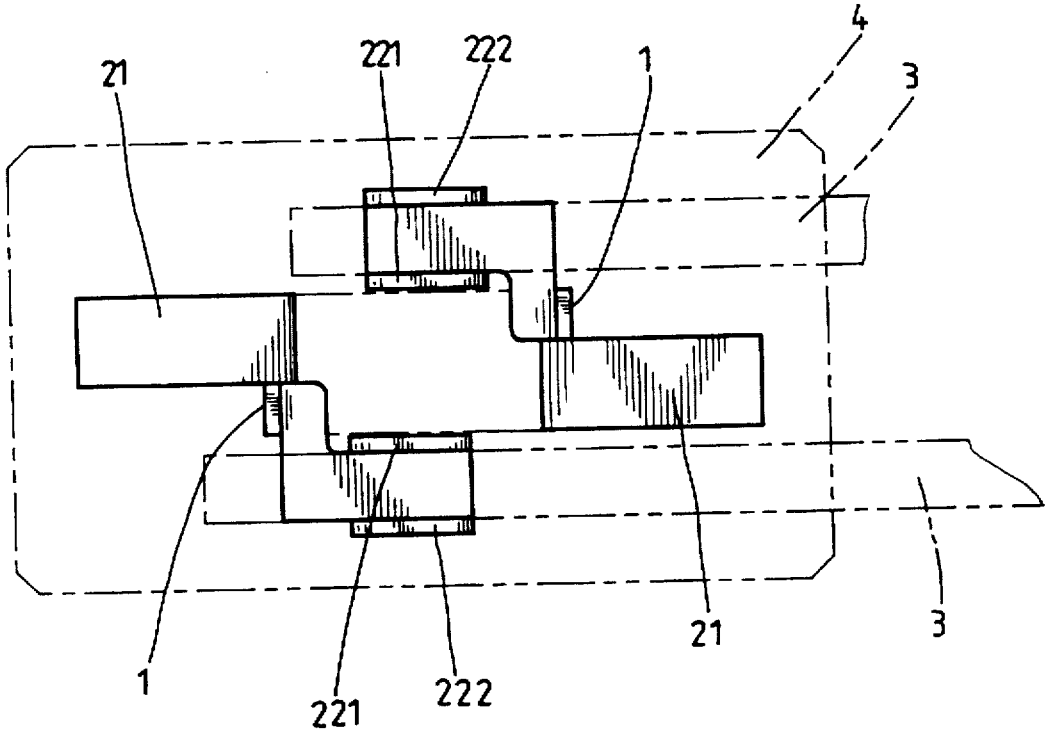
FIG. 5 is a bottom view showing the operation of the present invention.

In practising, referring to FIG. 3 through FIG. 5, the pluggers are arranged in proper positions in mould and covered the base portions by injecting plastic to form an integrated plug so that the exposed segments 1 are exposed outwardly, therein the ends of the exposed segments 1 are formed to arch shape.

Figure 6:
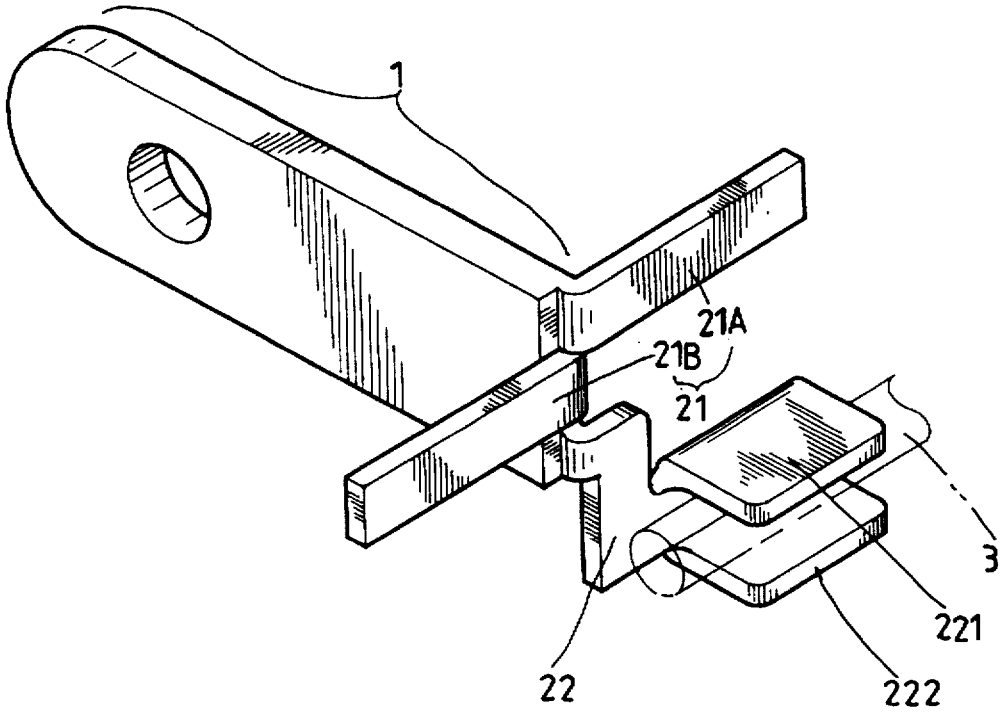
FIG. 6 is a perspective view showing a prong of a another embodiment of the present invention.
Figure 7:
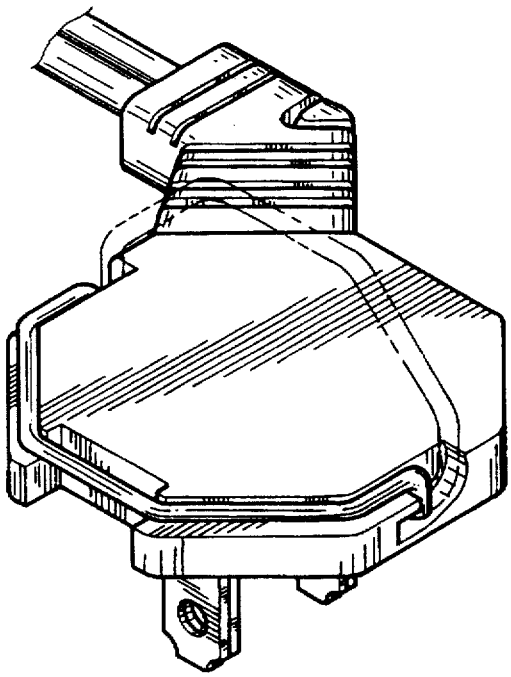
FIG. 7 (PRIOR ART)
FIG. 7 is a perspective view of a conventional plug.

Referring to FIG. 6, shows an operation of the present invention, wherein one separated lug 21 without two fins attaching on can be divided into two sub-lugs 21A 21B, in which they can be bent towards opposite directions respectively and horizontally.

I claim:

1. A prong for use in low profile molded plug comprising a planar conductive member having opposing first and second end portions, said first end portion having a first thickness dimension and extending longitudinally to an arch-shaped distal end for facilitating insertion thereof into an electrical outlet, said second end portion having a second thickness dimension, said second thickness dimension being thinner than said first thickness dimension, said second end portion being formed with a pair of lugs disposed in side-by-side relationship and extending in a direction transverse said longitudinal direction, a first of said pair of lugs having a pair of tab portions extending therefrom to form a wire receiving channel therebetween, where a second of said pair of lugs being divided into a pair of sub-lugs disposed in side-by-side relationship and extending in opposing directions.

* * * * *